US005507487A

United States Patent [19]

Hansen et al.

[11] Patent Number: 5,507,487

[45] Date of Patent: Apr. 16, 1996

[54] WIRE FORM FOR PINBALL SKILL LOOP SHOT

[75] Inventors: Bryan P. Hansen, DesPlaines; Roberto Hurtado, Elmwood Park, both of Ill.

[73] Assignee: Capcom Coin Op, Inc., Arlington Hts, Ill.

[21] Appl. No.: 398,957

[22] Filed: Mar. 2, 1995

[51] Int. Cl.[6] ..... A63F 7/36

[52] U.S. Cl. ..... 273/118 R; 273/119 R; 273/121 R

[58] Field of Search ..... 273/118–121, 123; 446/168–174

[56] References Cited

U.S. PATENT DOCUMENTS

| | | | |
|---|---|---|---|
| 3,683,514 | 8/1972 | Hughes | 446/168 X |
| 4,861,037 | 8/1989 | Oursler | 273/121 A X |
| 4,981,298 | 1/1991 | Lawlor et al. | 273/121 A |
| 5,358,240 | 10/1994 | Lawlor et al. | 273/119 A X |
| 5,358,241 | 10/1994 | Anghelo et al. . | |
| 5,383,663 | 1/1995 | Anghelo et al. | 273/118 R |

*Primary Examiner*—Raleigh W. Chin
*Attorney, Agent, or Firm*—Robert E. Browne; Gary R. Jarosik

[57] ABSTRACT

A wire form loop for use in conjunction with a pinball machine having a playfield on which is mounted a plurality of game play features. The playfield includes a shooter lane, play area, and drop area wherein at least one game play feature is located in the drop area. The wire form is provided for allowing a pinball to travel from the shooter lane to the play area and includes an entrance in the shooter lane, an exit to the play area, and an open area between the entrance and the exit. A spring biased plunger attached to the shooter lane is used to impart a plurality of speeds upon the pinball such that a first speed will allow the pinball to travel completely along the wire form from the entrance to the exit and a second speed will cause the pinball to fall from the open area of the wire form to the drop area. Preferably the wire form comprises parallel left and right bottom guides extending between the entrance and the exit with the left and right bottom guides each traveling through at least 180 degrees of rotation to form a portion in which the open area is disposed.

5 Claims, 2 Drawing Sheets

WIRE FORM FOR PINBALL SKILL LOOP SHOT

BACKGROUND OF THE INVENTION

This invention relates generally to pinball machines and, more particularly, relates to a wire form for creating a pinball skill loop shot.

Typical pinball machines consist of a playfield on which are disposed a plurality of play features such as targets, ramps, bumpers, or the like. Player controlled flippers are mounted on the playfield and are used by the player to direct a ball at selected play features at selected speeds to control game play and score points. To start play, a spring biased plunger is included and is used to launch the pinball onto the playfield. Currently, since the speed at which the pinball is launched onto the playfield is controllable by the player, certain machines employ skill shots to start game play where the object is to launch the ball at a predetermined speed to achieve a predetermined goal or action. Examples of such skill shot devices include a ramp positioned adjacent a plurality of concentric ring sections where the object is to launch the ball from the ramp into the ring section which will provide the player with the most starting points. Another example of such a device includes a series of adjacently positioned gates through which the pinball may be launched whereby the object is to launch the pinball by controlling the speed thereof through the one gate the pinball machine indicates as being valuable to the player. While these devices help to generate interest in pinball machines and draw players back to play, a need exists for a new skill shot to test players and to maintain a player's desire to continue play of the game.

As a result of these existing needs, it is an object of the present invention to provide a new skill shot which will generate interest among pinball machine players.

SUMMARY OF THE INVENTION

In accordance with the present invention a pinball machine is provided. The pinball machine has a playfield on which is mounted a plurality of game play features and includes a shooter lane, play area, and drop area wherein at least one game play feature is located. A wire form is provided for allowing a pinball to travel from the shooter lane to the play area and includes an entrance in the shooter lane, an exit to the play area, and an open area between the entrance and the exit. A spring biased plunger attached to the shooter lane is used to impart a plurality of speeds upon the pinball such that a first speed will allow the pinball to travel completely along the wire form from the entrance to the exit and a second speed will cause the pinball to fall from the open area of the wire form to the drop area.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used in conjunction with any variable speed launching device such as a flipper or the like, it will be described hereinafter in the context of a shooter lane attachment for a pinball machine as the preferred embodiment thereof.

Figures 1, 3, 4:
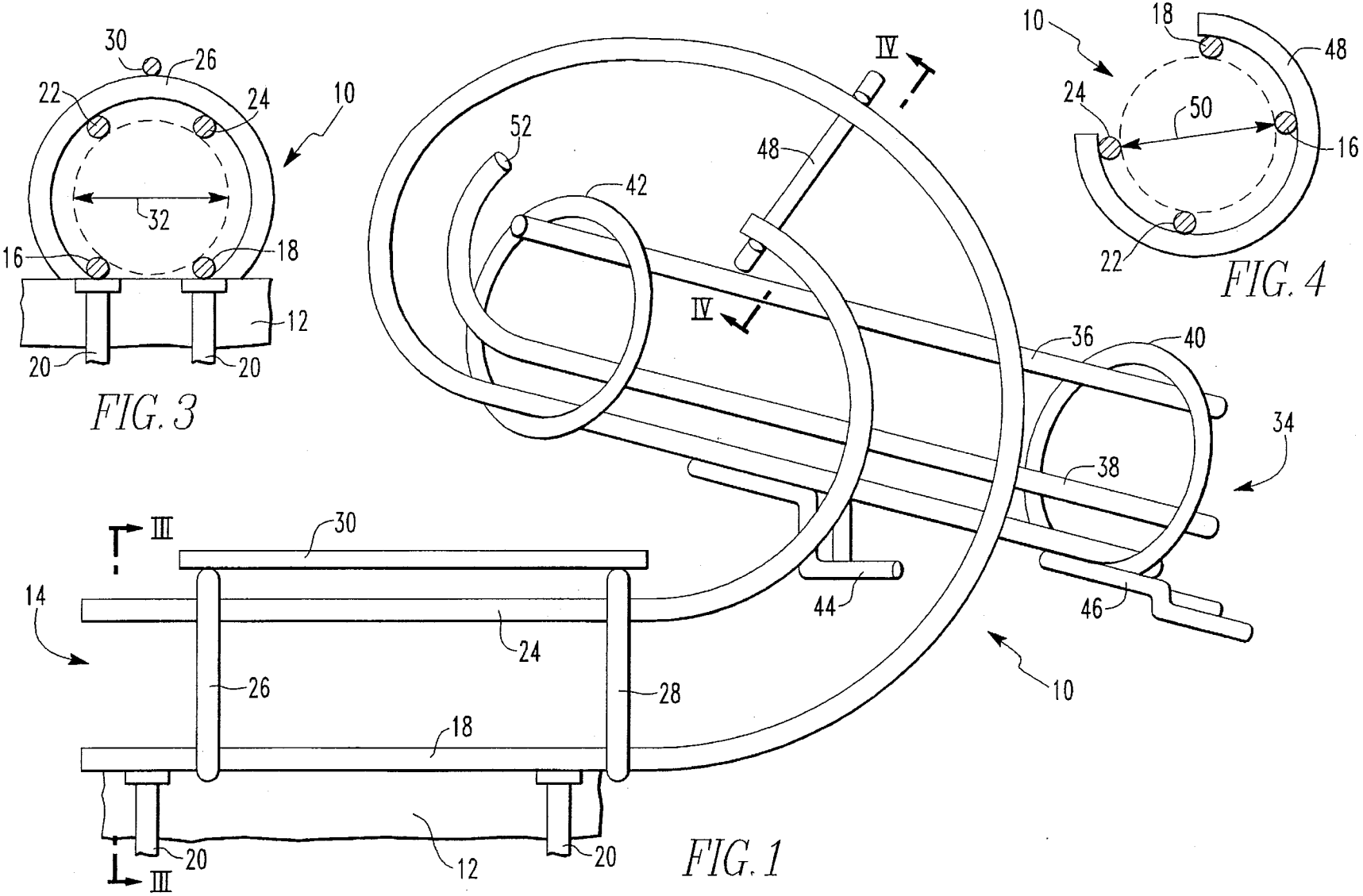
FIG. 1 is a side view of the wire form loop which is the subject of the present invention.
FIG. 3 is a cross-sectional view along the line III—III in FIG. 1.
FIG. 4 is a cross-sectional view along the line IV—IV in FIG. 1.
Figures 2, 5:
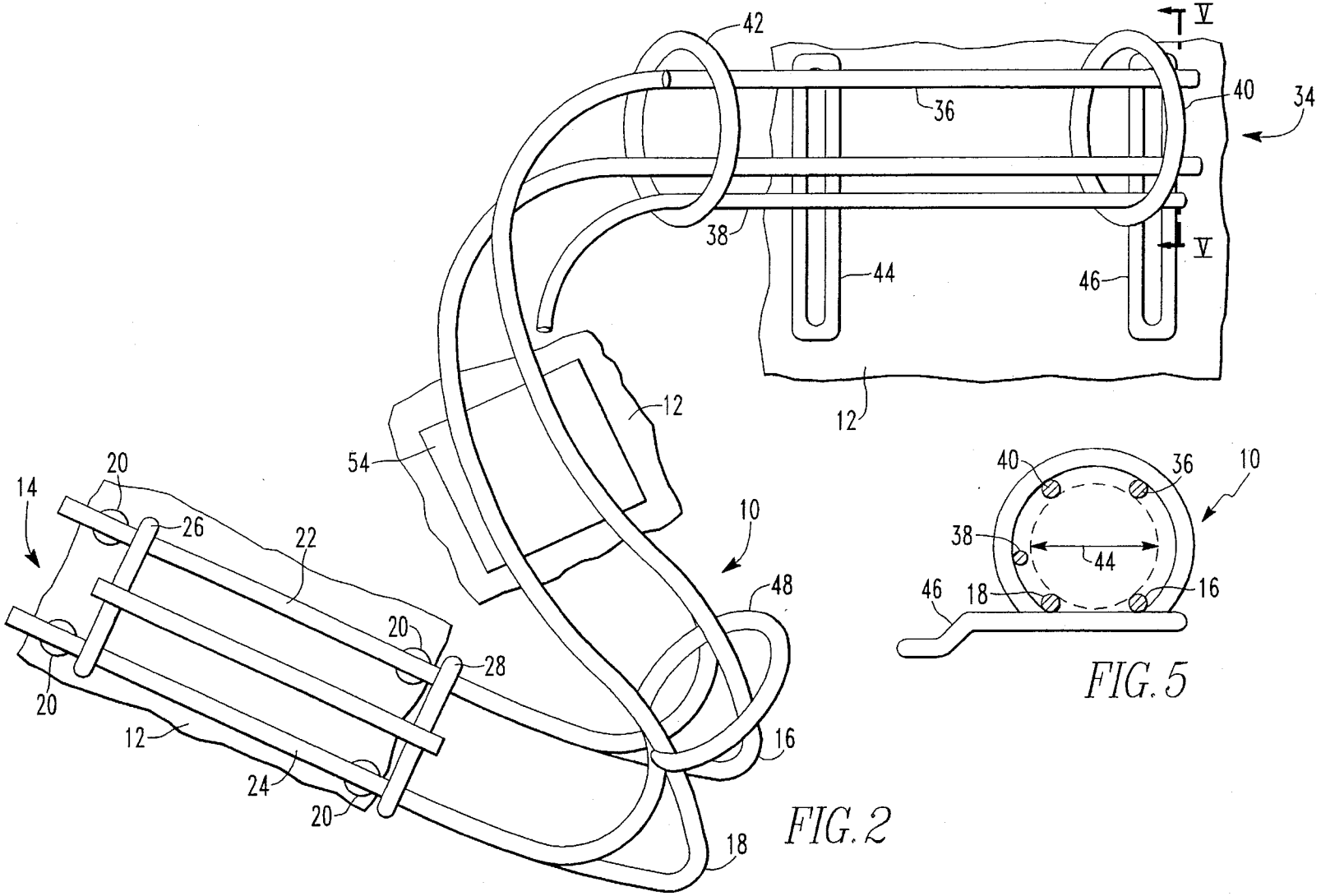
FIG. 2 is an overhead view of the wire form loop which is the subject of the present invention.
FIG. 5 is a cross-sectional view along the line V—V in FIG. 2.

Referring now to the figures, wherein like reference numerals refer to like elements, there is shown if FIGS. 1–5 a wire formed loop 10. Wire form 10 is illustrated as being mounted to playfield 12 with the entrance 14 thereof being positioned in the shooter lane where a plunger <not shown) will start the ball into play. It is to be noted that the location is illustrative only and other positions of the wire form 10 on the playfield 12 are contemplated where other launching type devices may cause the pinball to enter entrance 14.

The positioning of the entrance 14 is such that left and right bottom guide rails 16,18 relative to the playfield 12 allow a pinball to smoothly enter entrance 14. This is accomplished equally by counter-sinking the start of the guide rails 16,18 into the playfield, by beveling the start of the guide rails 16,18, or by providing a ramp on the playfield to raise the pinball to the level of entrance 14. To maintain the wire form 10 in position in the area of the entrance, mounting posts 20 are provide and secured into playfield 12 in any conventional manner.

To further assist in guiding the pinball in the vicinity of the entrance 14, left and right, top, entrance guide rails 22,24are provided. The four guide rails 16,18,22,24 are attached to both front ring 26 and rear ring 28 which rings 26,28 are further connected by rail 30 to provide further stability. The connections are done by spot welding the wire form pieces which are preferably constructed of smoothed, low carbon, drawn steel which is chrome plated thereafter. The length between rings 26,28 is substantially linear in construction. The diameter 32 between the interior of guides 16,18,22,24 is large enough to accommodate the pinball without impeding its progress and, in the illustrated embodiment, is provided with a diameter 32 of 1.145 inches.

The exit 34 of the wire form 10 consists of left and right guide rails 16,18 and left and right, top, exit guide rails 36,38. The guide rails 16,18,36,38 are connected by being spot welded to rings 40,42. The diameter 44 created by the interior of guide rails 16,18,36,38 is again preferably 1.145 inches in diameter. The length between rings 40,42 is substantially linear and preferably provided with a 10 degree decline. In the illustrated embodiment, the exit 34 is positioned approximately 28 degrees away from the entrance 14. To attach the exit area of wire form 10 to the playfield 12 a pair of supports 44,46 are provided which are attached to the playfield 12 by any conventional manner. It should be noted that the exit 34 and the entrance 14 may be in any planar relationship with one another provided the pinball can achieve sufficient velocity to negotiate the length of wire form 10 from entrance to exit.

The wire guides 16,18,22,24 are further connected in the vicinity of the ends of guides 22,24 by ring 48 such that the diameter 50 created between the interior of guides 16,18, 22,24 is again approximately 1.145 inches. The region between ring 48 and ring 26 is a first arcuate portion wherein the guides 16,18,22,24 are caused to turn approximately 145 degrees while maintaining their interior diameter relation. The region between ring 48 and ring 42 is a second arcuate portion wherein guides 16,18 are caused to turn approximately another 205 degrees. Throughout the lengths between rings 28 and 42 the distance between guides 16,18 is maintained at approximately 0.75 inches whereby a pinball will settle between the two guides. In the illustrated embodiment, while the wire form 10 is turning approximately 350 degree between rings 28,42, the Wire form 10 is also traversing approximately 6 inches laterally creating a type of corkscrew effect. It should be noted that the second arcuate portion may flatten at the top or be extended over a length to increase the open area through which the pinball will travel. Finally, guide 38 extends beyond ring 42 into an arcuate portion 52 which turns approximately 140 degrees to act as a pickup for helping the pinball into the exit section of wire form 10.

During operation, a pinball is caused to enter entrance 14 at a speed determined by the player, either from activation of a flipper, launching plunger, or the like. The pinball will travel through the entrance linear section to the first arcuate portion wherein the guides will start the pinball to loop. Upon leaving the first arcuate portion the pinball enters the second arcuate portion, or open area, where it is now supported by only two guides 16,18. If the pinball has enough speed, the pinball will maintain contact with guides 16,18 and finish the loop into the exit linear portion. If, however, the pinball is initially imparted with a lesser speed the pinball will not have enough momentum to maintain contact with guides 16,18 and will fall from the loop. Preferably, a target, switch, or similar game play feature 54 is provided on playfield 12 under the loop whereby it is an object of the player to impart the correct starting speed on the pinball such that the pinball will fall from the loop and contact the target area 54. By varying the length of the second arcuate portion and the degree of rotation one can control the exposure area and time the pinball will have in the open area.

While specific embodiments of the invention have been described in detail, it will be appreciated by those skilled in the art that various modifications and alternatives to those details could be developed in light of the overall teachings of the disclosure whereby the number of turns and open areas may be varied. Accordingly, the particular arrangements disclosed are meant to be illustrative only and not limiting as to the scope of the invention which is to be given the full breadth of the appended claims and any equivalent thereof.

We claim:

1. A pinball machine, comprising:

a playfield on which is mounted a plurality of game play features, said playfield having first, second, and third locations;

a pinball disposed on said playfield and used to contact said game play features;

a wire form for allowing said pinball to travel from said first location to said third location, said wire form having an entrance at said first location, an exit at said third location, and an open area between said entrance and said exit; and a speed controller attached to said playfield for imparting a plurality of speeds upon said pinball such that a first speed will allow said pinball to travel completely along said wire form from said first location to said third location and a second speed will cause said pinball to fall from said open area of said wire form to said second location.

2. The pinball machine as recited in claim 1, wherein one of said plurality of game play features is located at said second location.

3. The pinball machine as recited in claim 2, wherein said wire has a side profile which form travels through 360 degrees of rotation between said first location and said third location.

4. The pinball machine as recited in claim 3, wherein said wire form comprises a first arcuate portion and a second arcuate portion and wherein said first arcuate portion comprises at least three guides for preventing said pinball from falling from said wire form and said second arcuate portion comprises two guides whereby said pinball is allowed to fall from said second arcuate portion.

5. A pinball machine, comprising:

a playfield on which is mounted a plurality of game play features, said playfield having a shooter lane, play area, and drop area wherein at least one game play feature is located in said drop area;

a pinball disposed on said playfield and used to contact said game play features;

a wire form for allowing said pinball to travel from said shooter lane to said play area, said wire form having an entrance at said shooter lane, an exit at said play area, and an open area between said entrance and said exit;

a spring biased plunger attached to said shooter lane for imparting a plurality of speeds upon said pinball such that a first speed will allow said pinball to travel completely along said wire form from said entrance to said exit and a second speed will cause said pinball to fall from said open area of said wire form to said drop area; and wherein said wire form comprises parallel left and right bottom guides extending between said entrance and said exit, said left and right bottom guides each having a side profile traveling through at least 180 degrees of rotation to form a portion in which said open area is disposed.

* * * * *